US012692871B2

(12) United States Patent
Ou et al.

(10) Patent No.: US 12,692,871 B2
(45) Date of Patent: Jul. 28, 2026

(54) FAN MODULE WITH DETACHABLE DUAL-FAN ASSEMBLY

(71) Applicant: PURPLE CLOUD DEVELOPMENT PTE. LTD., Singapore (SG)

(72) Inventors: Xiangwei Ou, Hui Zhou City (CN); Shiman Xu, Hui Zhou City (CN)

(73) Assignee: PURPLE CLOUD DEVELOPMENT PTE. LTD., Singapore (SG)

( * ) Notice: Subject to any disclaimer, the term of this patent is extended or adjusted under 35 U.S.C. 154(b) by 0 days.

(21) Appl. No.: 19/328,961

(22) Filed: Sep. 15, 2025

(65) Prior Publication Data

US 2026/0132796 A1 May 14, 2026

(30) Foreign Application Priority Data

Nov. 13, 2024 (CN) ..... 202422761248.1

(51) Int. Cl.

| | |
|---|---|
| ***F04D 25/16*** | (2006.01) |
| ***F04D 13/06*** | (2006.01) |
| ***F04D 29/40*** | (2006.01) |
| ***F04D 29/52*** | (2006.01) |

(52) U.S. Cl.

CPC ..... *F04D 25/166* (2013.01); *F04D 13/0613* (2013.01); *F04D 29/40* (2013.01); *F04D 29/522* (2013.01)

(58) Field of Classification Search

CPC .... F04D 25/166; F04D 13/0613; F04D 29/40; F04D 29/522

See application file for complete search history.

(56) References Cited

U.S. PATENT DOCUMENTS

| | | | | |
|---|---|---|---|---|
| 6,612,817 | B2 * | 9/2003 | Lin | F04D 29/522 415/199.5 |
| 8,932,014 | B2 * | 1/2015 | Zhao | F04D 19/007 415/213.1 |
| 9,897,094 | B2 * | 2/2018 | Kang | F04D 29/522 |
| 11,022,128 | B2 * | 6/2021 | Inouchi | F04D 25/068 |
| 11,221,023 | B2 * | 1/2022 | Ma | F04D 29/646 |
| 11,668,320 | B2 * | 6/2023 | Ou | F04D 19/007 415/220 |
| 11,898,563 | B2 * | 2/2024 | Inouchi | F04D 13/12 |
| 2002/0122733 | A1 * | 9/2002 | Lin | F04D 29/522 417/423.5 |

(Continued)

*Primary Examiner* — Brian Christopher Delrue

(74) *Attorney, Agent, or Firm* — Merchant & Gould. P.C.

(57) ABSTRACT

A fan module for cooling electronic devices comprises a first fan and a second fan detachably coupled together. The first fan includes a first housing having latching slots, a first engagement member defining a first engagement slot with a first opening oriented toward a corresponding latching slot, and a first fan blade disposed within the first housing. The second fan includes a second housing, a second engagement member detachably fitted in the first engagement slot of the first engagement member, and a second fan blade disposed within the second housing. A latching member is disposed in the corresponding latching slots and configured to prevent the second engagement member from disengaging from the first engagement member. When assembled, the rotational axes of the fan blades are aligned to direct airflow from the first fan into the airflow path of the second fan, providing enhanced cooling performance.

18 Claims, 6 Drawing Sheets

(56) References Cited

U.S. PATENT DOCUMENTS

| | | | | |
|---|---|---|---|---|
| 2005/0024829 | A1* | 2/2005 | Horng | H05K 7/20172 361/695 |
| 2005/0260065 | A1* | 11/2005 | Kikuichi | F04D 25/166 415/60 |
| 2009/0022587 | A1* | 1/2009 | Yoshida | F04D 25/166 415/213.1 |
| 2009/0214336 | A1* | 8/2009 | Yoshida | F04D 29/646 415/214.1 |
| 2009/0214337 | A1* | 8/2009 | Yoshida | F04D 25/0613 415/214.1 |
| 2009/0246015 | A1* | 10/2009 | Hsu | F04D 19/007 415/213.1 |
| 2010/0329860 | A1* | 12/2010 | Li | H05K 7/20172 415/213.1 |
| 2013/0004293 | A1* | 1/2013 | Zhao | F04D 25/0613 415/66 |
| 2015/0167678 | A1* | 6/2015 | Yamazaki | F04D 29/403 415/183 |
| 2018/0195525 | A1* | 7/2018 | Hakozaki | F04D 29/384 |
| 2019/0301472 | A1* | 10/2019 | Kato | F04D 19/024 |
| 2019/0301473 | A1* | 10/2019 | Kato | F04D 29/522 |
| 2020/0217322 | A1* | 7/2020 | Chang | F04D 19/002 |
| 2021/0277916 | A1* | 9/2021 | Ma | F04D 19/007 |

* cited by examiner

FAN MODULE WITH DETACHABLE DUAL-FAN ASSEMBLY

CROSS-REFERENCE TO RELATED APPLICATIONS

This application is a non-provisional and claims priority to China Application No. 202422761248.1, filed on Nov. 13, 2024, the contents are thereby incorporated by reference in its entirety.

TECHNICAL FIELD

The present disclosure relates to cooling devices for electronic equipment, and more particularly to a fan module including a pair of fans that are detachably coupled together.

BACKGROUND

With ongoing advancements in electronic technology, the performance of electronic devices has significantly enhanced. However, such improvements in performance are often accompanied by increased heat generation. Effective heat dissipation is thus required to assure the stability, reliability, and longevity of electronic systems. To enhance the cooling performance of conventional fans, some manufacturers have endeavored to combine two fans together to increase airflow and facilitate heat dissipation.

However, the current designs lack an efficient technique for combining two fans into one single unit. Conventional approaches may necessitate screws, brackets, or supplementary fasteners, thereby increasing manufacturing complexity, assembly duration, and expenses.

Accordingly, there exists a necessity for a fan module that facilitates the seamless and dependable assembly of two fans without supplementary fasteners.

SUMMARY

In general terms, this disclosure is directed to cooling devices for heat generating devices. In some embodiment, and by non-limiting example, the present disclosure provides a fan module that includes a pair of fans detachably coupled together.

An aspect of the present disclosure provides a fan module for cooling electronic devices The fan module can include a first fan and a second fan. The first fan includes a first housing having a plurality of latching slots, a first engagement member disposed on the first housing. The first engagement member defines a first engagement slot, the first engagement slot has a first opening oriented toward a corresponding latching slot. The first fan can also include a first fan blade disposed within the first housing. The second fan can include a second housing, a second engagement member disposed on the second housing, a second fan blade disposed within the second housing and a latching member disposed in corresponding latching slots. The second engagement member is detachably fitted in the first engagement slot of the first engagement member. The latching member is configured to prevent the second engagement member from disengaging from the first engagement member.

In one embodiment, at least one of the plurality of latching slots includes a guide slope, and the latching member includes two opposing cam surfaces facing each other, the guide slope being configured to interact with a corresponding cam surface to facilitate engagement.

In one embodiment, the latching member includes a base portion, two side arm portions connected to opposite sides of the base portion, and two hook portions respectively connected to distal ends of the side arm portions, the hook portions each having a cam surface facing a corresponding latching slot.

In one embodiment, the latching member at least partially overlaps the second engagement member in a circumferential direction of rotation of the second fan blade to prevent the second engagement member from disengaging from the first engagement member.

In one embodiment, the fan module further includes a stop member. The first fan includes a third engagement member disposed on the first housing and the third engagement member defines a second engagement slot having an opening oriented toward the stop member. The second fan includes a fourth engagement member disposed on the second housing and the fourth engagement member is detachably fitted in the second engagement slot of the third engagement member.

In one embodiment, each of the first, second, third, and fourth engagement members includes two spaced-apart members, the first engagement member and the third engagement member are alternately arranged, and the second engagement member and the fourth engagement member are alternately arranged.

In one embodiment, the first engagement member includes an extension section extending from the first housing toward the second fan, and a bent section extending from the extension section at an angle relative to the extension section, the bent section having a first positioning surface facing the first fan blade, the second engagement member having a second positioning surface facing away from the first fan blade, the first positioning surface and the second positioning surface being in contact with each other and forming an acute angle relative to a rotation axis of the second fan blade.

In one embodiment, the bent section further includes a third positioning surface adjacent to the first opening, the second engagement member includes a fourth positioning surface facing away from the latching member, and the third positioning surface and the fourth positioning surface being in contact with teach other and extending parallel to the rotation axis of the second fan blade.

In one embodiment, the extension section and the bent section together define a fifth positioning surface facing the rotation axis of the second fan blade, the second housing includes a sixth positioning surface on an outer side thereof, and the fifth positioning surface and the sixth positioning surface being in contact with each other and extending parallel to a circumferential direction of rotation of the second fan blade.

In one embodiment, the first housing includes a seventh positioning surface facing the second housing, the second housing includes an eighth positioning surface facing the first housing, and the seventh positioning surface and the eighth positioning surface being in contact with each other and extending perpendicular to the rotation axis of the second fan blade.

Another aspect of the present disclosure provides a fan module for cooling electronic devices. The fan module can include a first fan with a first housing, a second fan with a second housing, and a stop member disposed on the first housing. A first engagement member projects from the first housing, and a first fan blade is disposed within the first housing. A second engagement member projects from the second housing and is detachably coupled to the first engagement member, and a second fan blade is disposed within the second housing. The first housing further includes a third engagement member having a second engagement slot with a second opening facing the stop member, and the second housing further includes a fourth engagement member detachably fitted in the second engagement slot.

In one embodiment, the first housing includes a plurality of latching slots, the second fan includes at least one latching member fitted in corresponding latching slots, at least one of the latching slots having a guide slope, and the latching member including two opposing cam surfaces, the guide slope being configured to interact with a corresponding cam surface to facilitate engagement.

DETAILED DESCRIPTION

Figure 1:
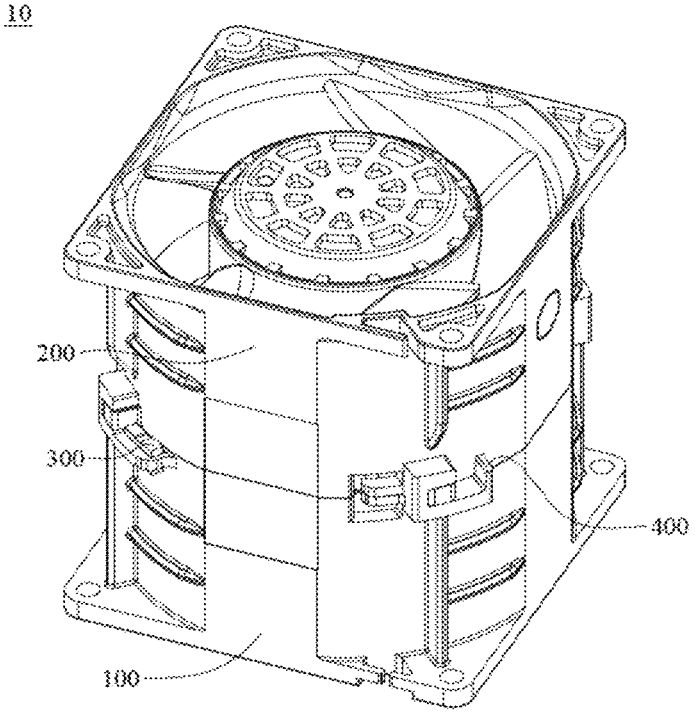
FIG. 1 is a perspective view of a fan module in accordance with one embodiment of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Figure 2:
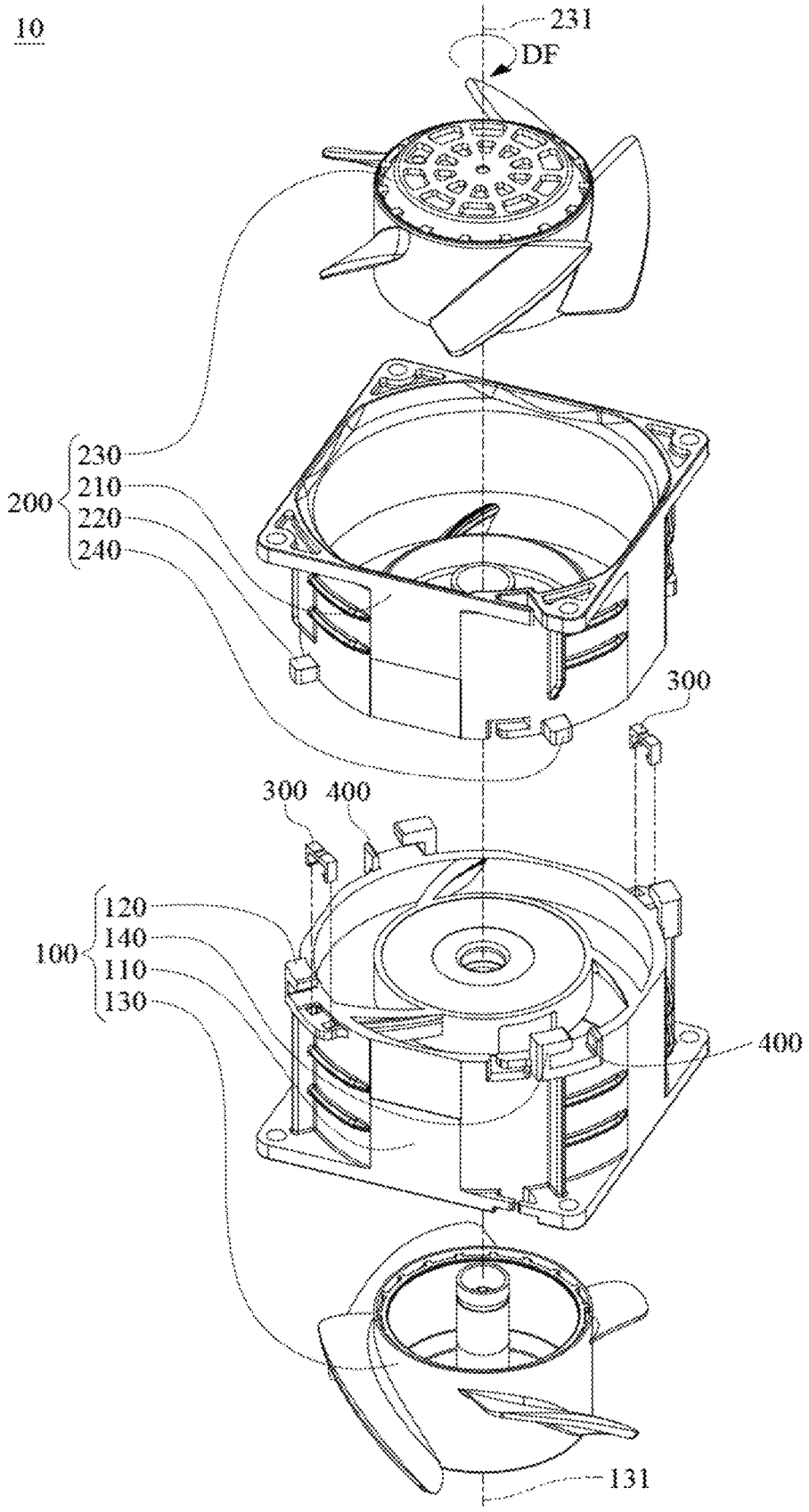
FIG. 2 is an exploded view of the fan module of FIG. 1.
Figure 3:
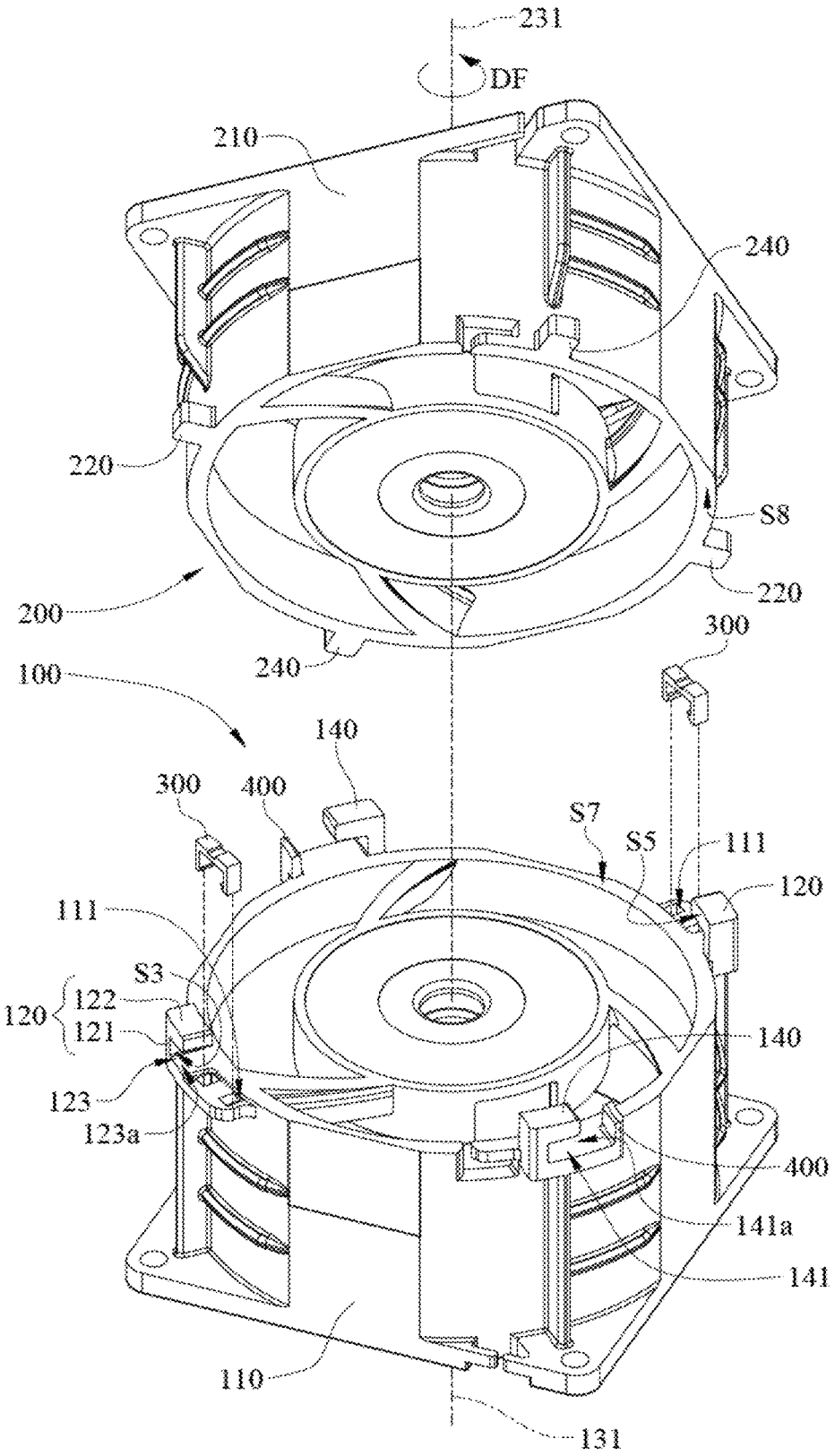
FIG. 3 is an exploded view illustrating the first fan and the second fan of the fan module of FIG. 1.
Figure 4:
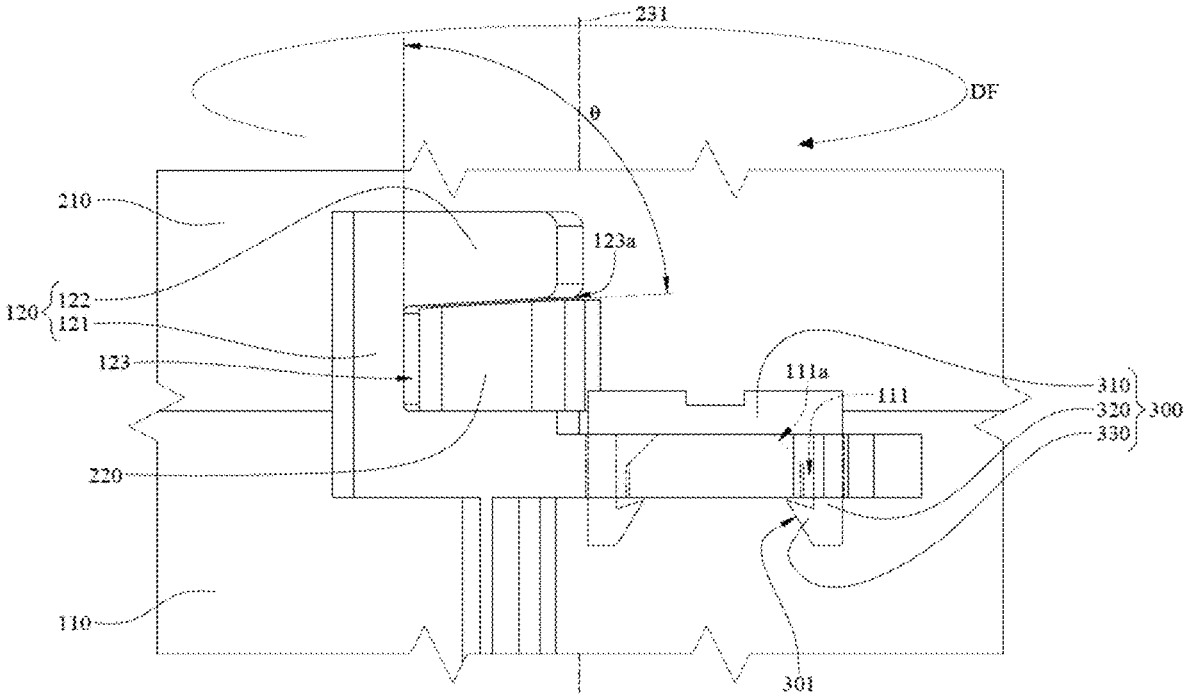
FIG. 4 is an enlarged partial view of the fan module of FIG. 1.
Figure 5:
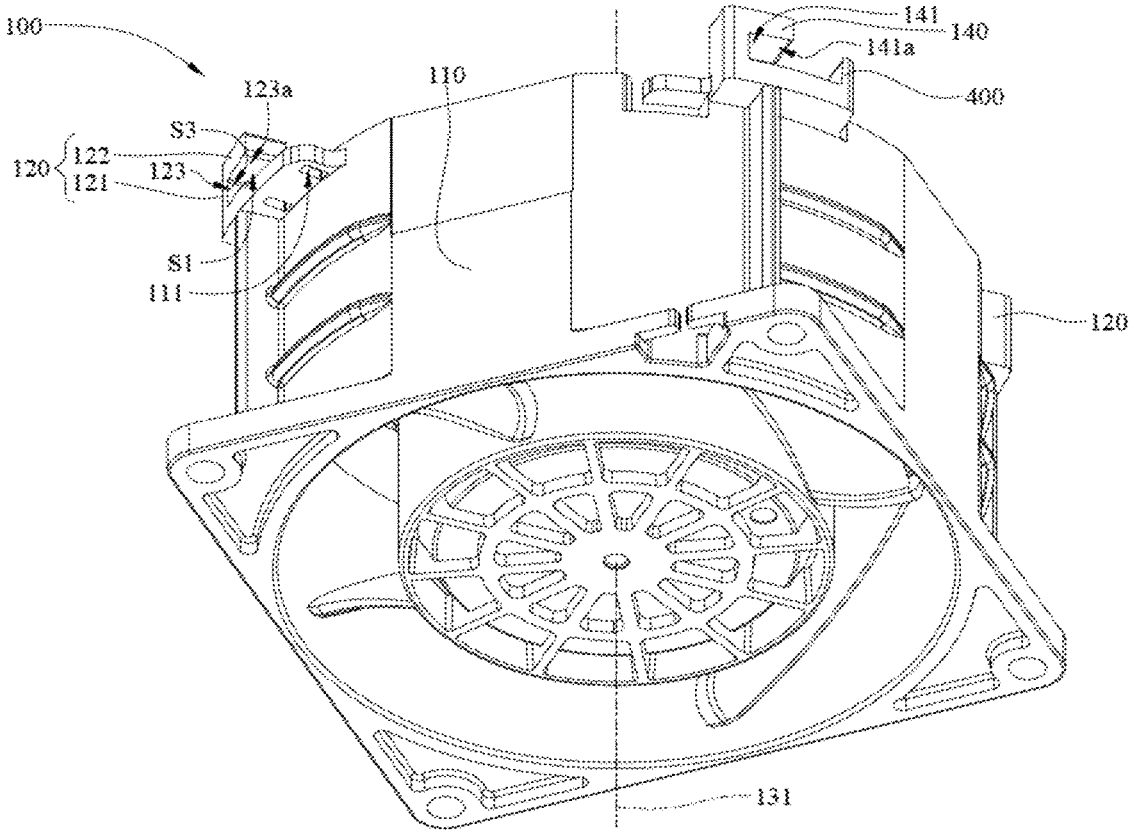
FIG. 5 is a perspective view of the first fan of the fan module of FIG. 1.
Figure 6:
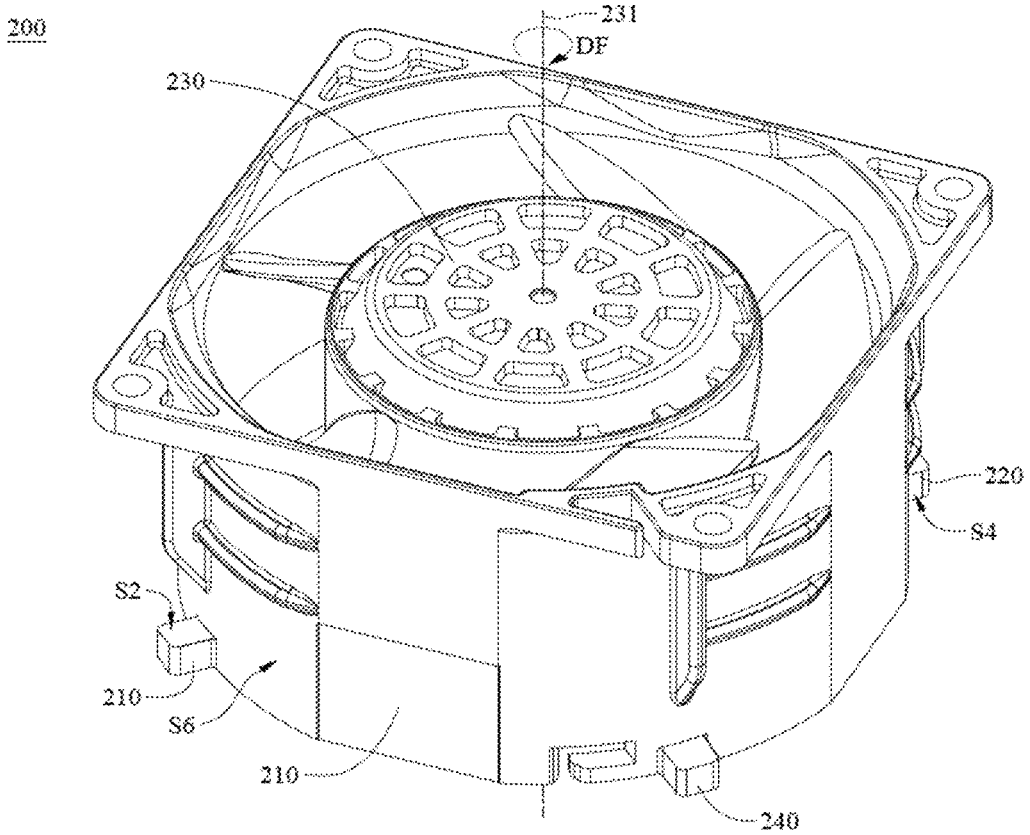
FIG. 6 is a perspective view of the second fan of the fan module of FIG. 1.

Referring to FIGS. 1 to 6, FIG. 1 is a perspective view of a fan module in accordance with one embodiment of the present disclosure. FIG. 2 is an exploded view of the fan module of FIG. 1. FIG. 3 is an exploded view illustrating the first fan and the second fan of the fan module of FIG. 1. FIG. 4 is an enlarged partial view of the fan module of FIG. 1. FIG. 5 is a perspective view of the first fan of the fan module of FIG. 1. FIG. 6 is a perspective view of the second fan of the fan module of FIG. 1.

As an example illustrated in FIG. 1, the fan module 10 includes a first fan 100, a second fan 200, a pair of latching members 300, and a pair of stop members 400. In some embodiments, the first fan 100 and the second fan 200 are detachably coupled to one another via latching members 300. The stop members 400 are disposed on opposite sides of the fan module 10 to ensure positional stability and restrict unwanted fan displacement during assembly and operation.

In some embodiments, the first fan 100 includes a first housing 110, two first engagement members 120, and a first fan blade 130. The first housing 110 may include two latching slots 111 disposed on opposing sides of the first housing 110, respectively. The first engagement members 120 may be disposed on the opposite sides of the first housing 110, respectively. Each first engagement member 120 may include an extension section 121 and a bent section 122. However, the embodiment is not limited thereto. In other embodiments, the first engagement slot 123 may be formed only by one single extension section or one single bent section.

In some embodiments, the extension section 121 extends from the first housing 110 toward the second fan 200. The bent section 122 extends from a distal end of the extension section 121 in a direction distinct from that of the extension section. The extension section 121, the bent section 122, and the first housing 110 together define a first engagement slot 123. Each first engagement slot 123 further includes a first opening 123*a* oriented toward a corresponding latching slot 111. The first fan blade 130 is disposed within the first housing 110. However, the disclosure is not limited thereto. In other embodiments, the first engagement slot 123 may be formed only by one single extension section or one single bent section.

In some embodiments, the second fan 200 includes a second housing 210, two second engagement members 220, and a second fan blade 230. Each second engagement member 220 is positioned on opposite sides of the second housing 210 and is designed to be detachably fitted in the corresponding first engagement slot 123 of the first engagement member 120. Similar to the first fan 100, the second fan blade 230 is disposed within the second housing 210.

In some embodiments, each of the latching members 300 is disposed in the corresponding latching slot 111 and configured to prevent the second engagement members 220 from disengaging from the first engagement members 120. For example, the latching members 300 are configured to prevent unintended or accidental disengagement of the second engagement members 220 from the first engagement members 120, thereby ensuring that the first fan 100 and the second fan 200 remain properly secured during operation.

In some embodiments, the first fan 100 and the second fan 200 can be combined by engaging the first engagement members 120, the second engagement members 220, and the latching members 300. Once properly assembled, the rotational axis 131 of the first fan blade 130 is aligned with the rotational axis 231 of the second fan blade 230. By aligning the rotational axes, the airflow generated by the first fan blade 130 is directed into the airflow path of the second fan blade 230, thereby enabling the second fan blade 230 to accelerate and enhance the airflow. This serial arrangement of the two fans reduces turbulence between stages while increasing static pressure, allowing the fan module 10 to provide a powerful and concentrated airflow suitable for enhanced cooling performance.

In some embodiments, the latching members 300 may be removed by a suitable tool, allowing the first fan 100 and the second fan 200 to be separated when needed. The latching members 300 are reusable; if a latching member 300 is damaged during removal, it can be replaced without replacing the first fan 100 or the second fan 200, lowering maintenance costs and avoiding damage to the fans themselves. It will be appreciated that the present disclosure is not limited by the number of components employed.

In some embodiments, each of the two latching slots 111 may be formed with one guide slope 111*a* disposed on surfaces oriented towards the latch member 300. Correspondingly, the latch member 300 may include two cam surfaces 301 facing one another. The guide slopes 111*a* of the two latching slots 111 and the two cam surfaces 301 of the latch member 300 collaborate to provide a camming action that gradually deflects the latch member 300 and aligns it with the latching slot 111 during insertion, facilitating smoother engagement. For example, the guide slopes 111*a* of the two latching slot 111 may primarily serve to deflect the latch arm inward, while the two cam surfaces 301 of the latch member 300 may primarily facilitate entry and prevent snagging. However, the present disclosure is not limited to a specific number or arrangement of such features. In other embodiments, the two latching slots 111 may include only one single guide slope in total, multiple guide slopes of varying angles, or no slope at all, and the latch member 300 may include one or more cam surfaces or other guiding geometries.

In some embodiment, each latching member 300 may include a base portion 310, two side arm portions 320, and two hook portions 330. Each side arm portion 320 is connected to opposite sides of the base portion 310. Each hook portion 330 is connected to a distal end of a corresponding side arm portion 320 opposite the base portion 310, and each hook portion 330 may include the cam surface 301 described above. The configuration of the base portion 310, side arm portions 320, and hook portions 330 allows the latching member 300 to be more easily and reliably engaged with the latching slot 111. Accordingly, the configuration reduces assembly errors, accurately aligns the latching member, and ensures steady retention during fan operation.

As an example illustrated in FIG. 4, the latching member 300 may at least partially cover the second engagement member 220 in a circumferential direction DF of rotation of the second fan blade 230. This overlapping configuration allows the latching member 300 to prevent the second engagement member 220 from moving in the opposite circumferential direction, thereby averting unintended disengagement from the first engagement member 120. This arrangement enhances the stability and dependability of the fan module during high-speed operation.

In some embodiments, the two stop members 400 are positioned on opposite sides of the first housing 110. The first fan 100 may further include two third engagement members 140 disposed on opposite sides of the first housing 110. Each third engagement member 140 defines a second engagement slot 141 with a second opening 141*a*. The second fan 200 may further include two fourth engagement members 240 disposed on opposite sides of the second housing 210, each of which may be detachably fitted in the second engagement slot 141 of a corresponding third engagement member 140. The first engagement members 120 and third engagement members 140 are alternately arranged on the first housing 110, and the second engagement members 220 and fourth engagement members 240 are alternately arranged on the second housing 210. The arrangement, from the first engagement member 120 to the fourth engagement member 240, strengthens the coupling of the second fan 200 to the first fan 100.

Additionally, the stop members 400 also restrict excessive movement of the fourth engagement members 240 when they are disengaged from the third engagement members 140, thereby protecting the components and facilitating safe assembly or disassembly.

In some embodiments, the bent section 122 of each first engagement member 120 may include a first positioning surface S1 facing the first fan blade 130. Each second engagement member 220 may include a second positioning surface S2 facing away from the first fan blade 130. The first positioning surface S1 and the second positioning surface S2 are in contact, forming an acute angle θ relative to the rotational axis 231 of the second fan blade 230, as shown in FIG. 4. This configuration positions the first fan 100 and the second fan 200 relative to one another along a direction parallel to the rotational axis 231, ensuring precise alignment. The acute angle θ enhances the insertion of the second engagement member 220 into the first engagement member 120, minimizing assembly force and ensuring secure engagement. By precisely aligning the rotational axes of the fan blades, the airflow between the first and second fans is properly directed, thereby maximizing airflow strength, minimizing turbulence, and improving the overall cooling performance of the fan module 10.

In some embodiments, the bent section 122 of each first engaging member 120 may include a third positioning surface S3 on the side near the first opening 123*a*. Each second engaging member 220 may include a fourth positioning surface S4 on the side opposite to the latching member 300, as shown in FIGS. 5 and 6, respectively. The third positioning surface S3 and the fourth positioning surface S4 adjoin one another and extend parallel to the rotational axis 231 of the second fan blade 230. According to this arrangement, the first fan 100 and the second fan 200 are circumferentially aligned relative to one another along the circumferential direction DF.

In some embodiments, the extension portion 121 and the bent section 122 of each first engaging member 120 together define a fifth positioning surface S5 oriented toward the rotational axis 231 of the second fan blade 230, as shown in FIG. 3. The second housing 210 may include a sixth positioning surface S6 on its outer side, as shown in FIG. 6. The fifth positioning surface S5 and the sixth positioning surface S6 adjoin one another and extend parallel to the circumferential direction DF of the rotating second fan blade 230. With this configuration, the first fan 100 and the second fan 200 are positioned relative to one another in a direction perpendicular to the rotational axis 231.

In some embodiments, as shown in FIG. 3, the first housing 110 includes a seventh positioning surface S7 on the side facing the second housing 210. The second housing 210 includes an eighth positioning surface S8 on the side facing the first housing 110. The seventh positioning surface S7 and the eighth positioning surface S8 adjoin one another and extend perpendicular to the rotational axis 231 of the second fan blade 230. With this configuration, the first fan 100 and the second fan 200 are further positioned relative to one another in a direction parallel to the rotational axis 231.

In the fan module of the foregoing embodiments, the combination of the first engaging members, the second engaging members, and the latching members enables the first fan and the second fan to be conveniently assembled together, with the rotational axis of the first fan blade aligned to that of the second fan blade to generate a strong and concentrated airflow. The inclined guiding features further allow the latching members to be smoothly directed into the latch recesses, resulting in secure engagement. In some embodiments, the latching members at least partially cover the second engaging members in the circumferential direction of the second fan blade, thereby preventing disengagement and strengthening the coupling between the two fans.

The engagement is further strengthened through the collaborative arrangement of the first through fourth engaging members, while the stop members prevent excessive movement upon the release of the fourth engaging member from the third engaging member. In addition, the first and second positioning surfaces are oriented at an acute angle relative to the rotational axis of the second fan blade, allowing for a more reliable engagement of the second engaging member with the first engaging member. Furthermore, the first through eighth positioning surfaces enable consistent and precise alignment of the first fan and the second fan in multiple directions, ensuring ease of assembly and mechanical stability.

Therefore, embodiments disclosed herein are well adapted to attain the ends and advantages mentioned as well as those that are inherent therein. The particular embodiments disclosed above are illustrative only, as the embodiments disclosed may be modified and practiced in different but equivalent manners apparent to those of ordinary skill in the relevant art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. Of course, the disclosed embodiments are merely exemplary embodiments and that various modifications can be made without departing from the spirit and scope of the disclosure. Further, it should be understood that various aspects of the embodiment are not mutually exclusive of each other and can be combined as desired by a person of ordinary skill in the art as a matter of design choices.

The embodiments illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some number. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces.

What is claimed is:

1. A fan module for cooling electronic devices, the fan module comprising:

a first fan, including:

a first housing having a plurality of latching slots;

a first engagement member disposed on the first housing, the first engagement member defining a first engagement slot, the first engagement slot having a first opening oriented toward a corresponding latching slot; and a first fan blade disposed within the first housing; and a second fan, including:

a second housing;

a second engagement member disposed on the second housing, the second engagement member being detachably fitted in the first engagement slot of the first engagement member;

a second fan blade disposed within the second housing; and a latching member disposed in corresponding latching slots and configured to prevent the second engagement member from disengaging from the first engagement member.

2. The fan module of claim 1, wherein at least one of the plurality of latching slots includes a guide slope, and the latching member includes two opposing cam surfaces facing each other, the guide slope being configured to interact with a corresponding cam surface to facilitate engagement.

3. The fan module of claim 1, wherein the latching member includes a base portion, two side arm portions connected to opposite sides of the base portion, and two hook portions respectively connected to distal ends of the side arm portions, the hook portions each having a cam surface facing a corresponding latching slot.

4. The fan module of claim 1, wherein the latching member at least partially overlaps the second engagement member in a circumferential direction of rotation of the second fan blade to prevent the second engagement member from disengaging from the first engagement member.

5. The fan module of claim 1, further comprising a stop member, wherein:

the first fan includes a third engagement member disposed on the first housing, the third engagement member defining a second engagement slot having an opening oriented toward the stop member; and the second fan includes a fourth engagement member disposed on the second housing, the fourth engagement member being detachably fitted in the second engagement slot of the third engagement member.

6. The fan module of claim 5, wherein each of the first, second, third, and fourth engagement members includes two spaced-apart members, the first engagement member and the third engagement member are alternately arranged, and the second engagement member and the fourth engagement member are alternately arranged.

7. The fan module of claim 1, wherein the first engagement member includes an extension section extending from the first housing toward the second fan, and a bent section extending from the extension section at an angle relative to the extension section, the bent section having a first positioning surface facing the first fan blade, the second engagement member having a second positioning surface facing away from the first fan blade, the first positioning surface and the second positioning surface being in contact with each other and forming an acute angle relative to a rotation axis of the second fan blade.

8. The fan module of claim 7, wherein the bent section further includes a third positioning surface adjacent to the first opening, the second engagement member includes a fourth positioning surface facing away from the latching member, and the third positioning surface and the fourth positioning surface being in contact with teach other and extending parallel to the rotation axis of the second fan blade.

9. The fan module of claim 8, wherein the extension section and the bent section together define a fifth positioning surface facing the rotation axis of the second fan blade, the second housing includes a sixth positioning surface on an outer side thereof, and the fifth positioning surface and the sixth positioning surface being in contact with each other and extending parallel to a circumferential direction of rotation of the second fan blade.

10. The fan module of claim 9, wherein the first housing includes a seventh positioning surface facing the second housing, the second housing includes an eighth positioning surface facing the first housing, and the seventh positioning surface and the eighth positioning surface being in contact with each other and extending perpendicular to the rotation axis of the second fan blade.

11. A fan module for cooling electronic devices, the fan module comprising:

a first fan including a first housing, a first engagement member projecting from the first housing, and a first fan blade disposed within the first housing;

a second fan including a second housing, a second engagement member projecting from the second housing and detachably coupled to the first engagement member, and a second fan blade disposed within the second housing; and a stop member disposed on the first housing, wherein the first housing includes a third engagement member having a second engagement slot with a second opening facing the stop member, and the second housing includes a fourth engagement member detachably fitted in the second engagement slot;

wherein the first housing includes a plurality of latching slots, the second fan includes at least one latching member fitted in corresponding latching slots, at least one of the latching slots having a guide slope, and the latching member including two opposing cam surfaces, the guide slope being configured to interact with a corresponding cam surface to facilitate engagement.

12. The fan module of claim 11, wherein the latching member includes a base portion, two side arm portions connected to opposite sides of the base portion, and two hook portions respectively connected to distal ends of the side arm portions, the hook portions each having a cam surface facing a corresponding latching slot.

13. The fan module of claim 11, wherein the latching member at least partially covers the second engagement member in a circumferential direction of rotation of the second fan blade to prevent the second engagement member from disengaging from the first engagement member.

14. The fan module of claim 11, wherein each of the first, second, third, and fourth engagement members includes two spaced-apart members, the first engagement member and the third engagement member are alternately arranged, and the second engagement member and the fourth engagement member are alternately arranged.

15. The fan module of claim 11, wherein the first engagement member includes an extension section extending from the first housing toward the second fan, and a bent section extending from the extension section at an angle relative to the extension section, the bent section having a first positioning surface facing the first fan blade, the second engagement member having a second positioning surface facing away from the first fan blade, the first positioning surface and the second positioning surface being in contact with each other and forming an acute angle relative to a rotation axis of the second fan blade.

16. The fan module of claim 15, wherein the bent section further includes a third positioning surface adjacent to the first opening, the second engagement member includes a fourth positioning surface facing away from the latching member, and the third positioning surface and the fourth positioning surface being in contact with each other and extending parallel to the rotation axis of the second fan blade.

17. The fan module of claim 16, wherein the extension section and the bent section together define a fifth positioning surface facing the rotation axis of the second fan blade, the second housing includes a sixth positioning surface on an outer side thereof, and the fifth positioning surface and the six positioning surface being in contact with each other and extending parallel to a circumferential direction of rotation of the second fan blade.

18. The fan module of claim 17, wherein the first housing includes a seventh positioning surface facing the second housing, the second housing includes an eighth positioning surface facing the first housing, and the seventh positioning surface and the eighth positioning surface being in contact with each other and extending perpendicular to the rotation axis of the second fan blade.

* * * * *